US010542848B1

(12) United States Patent
Lin

(10) Patent No.: US 10,542,848 B1
(45) Date of Patent: Jan. 28, 2020

(54) BATHING AUXILIARY CHAIR

(71) Applicant: Forever Young Enterprise Co., Ltd., New Taipei (TW)

(72) Inventor: Fang-Sheng Lin, Tainan (TW)

(73) Assignee: Forever Young Enterprise Co., Ltd., New Taipei (TW)

( * ) Notice: Subject to any disclaimer, the term of this patent is extended or adjusted under 35 U.S.C. 154(b) by 0 days.

(21) Appl. No.: 16/167,604

(22) Filed: Oct. 23, 2018

(30) Foreign Application Priority Data

Sep. 14, 2018 (TW) ..... 107132509 A

(51) Int. Cl.
*A47K 3/12* (2006.01)

(52) U.S. Cl.
CPC ..... *A47K 3/122* (2013.01)

(58) Field of Classification Search
CPC ..... A47K 3/122
USPC ..... 4/579
See application file for complete search history.

(56) References Cited

U.S. PATENT DOCUMENTS 3,718,365 A * 2/1973 Gibson ..... A47C 9/10 4/579
5,606,751 A * 3/1997 Baker ..... A47K 3/122 4/579
6,681,415 B1 * 1/2004 Gallo ..... A47K 3/122 4/578.1

* cited by examiner

*Primary Examiner* — Tuan N Nguyen
(74) *Attorney, Agent, or Firm* — Alan D. Kamrath; Mayer & Williams PC

(57) ABSTRACT

A bathing auxiliary chair suitable for bathtubs of different sizes generally includes a seating unit and a supporting unit. The seating unit, which allows a user to sit thereon while bathing, is supported by the supporting unit and can be moved between a first position and a second position. The seating unit is provided with a front guide shell and two rear guide shells. In use, when the seating unit is located at the first position or the second position, one of the rear guide shells can abut against a fastener located at a rear tube of the supporting unit, and the front guide shell can be coupled to a front tube of the supporting unit through a button of a snap mechanism, so that the seating unit can be fixed at the position reliably, and the bathing auxiliary chair can be used safely.

10 Claims, 13 Drawing Sheets

BATHING AUXILIARY CHAIR

BACKGROUND OF THE INVENTION

1. Field of the Invention

The present invention relates to a bathing auxiliary chair and, more particularly, to a chair that can be applied to bathtubs of different sizes to facilitate mobility-impaired persons taking a bath.

2. Description of the Related Art

Persons with disabled lower limbs or impaired mobility cannot live independently. They often rely on carers and assistant devices in daily living activities, such as getting up, rehabilitating, or bathing. In a bathing activity, a carer should assist a disabled person to move into a bathroom, and then help the disabled person sitting on a bathing auxiliary chair to proceed with a bath. In conventional chairs for assisting baths, the seat portion thereof is usually secured on its supportive legs. It is laborious and difficult for a carer to change the position of the chair. Besides, the process of changing the chair's position is dangerous for a disabled or mobility-impaired person. Although some bathing auxiliary chair is provided with a movable seat portion, it is inconvenient in operation, besides, since the seat portion thereof cannot be fixed properly after changing its position, the chair is easy to shake, thus causing a danger to the user. In particular, when leaving or sitting on the chair, users usually need to hold the armrest of the chair. If the seat portion or the armrest of the chair is subjected to excessive force, the chair may shake or become tilted. Another disadvantage is that the conventional bath chair can only be applied to a bathtub of a specific size.

BRIEF SUMMARY OF THE INVENTION

Thus, an objective of the present invention is to provide a bathing auxiliary chair, which can be adjusted in lateral width to be applied to bathtubs of different sizes. Furthermore, the seating unit of the bathing auxiliary chair can be moved laterally and fixed reliably, so that the chair can be used more convenient and safely.

To achieve this and other objectives, a bathing auxiliary chair of the present invention, which can be installed on a bathtub for allowing a mobility-impaired person to take a bath while sitting thereon, generally includes a seating unit, a supporting unit, and first and second snap mechanisms. The seating unit includes a fixed plate, a seat portion mounted above the fixed plate, a front guide shell provided at a front side of the fixed plate, and at least one rear guide shell provided at a rear side of the fixed plate. The front guide shell defines a central through-hole and a positioning hole communicating with the through-hole. The supporting unit includes a front tube, a rear tube, and two lateral supportive frames spaced in a transverse direction and adapted to be placed on two opposite sidewalls of a bathtub respectively. Each lateral supportive frame includes a base rod and first and second connection tubes spaced in longitudinal direction perpendicular to the transverse direction and extending inwardly from the base rod in the transverse direction. Each of the front and rear tubes has a first end section, a second end section, and an intermediate section between the first and second end sections. The front tube extends in the transverse direction through the front guide shell, and the first and second end sections of the front tube are connected with the first connection tubes of the two lateral supportive frames. The rear tube extends in the transverse direction through the at least one rear guide shell, and the first and second end sections of the rear tube are connected with the second connection tubes of the two lateral supportive frames. The at least one rear guide shell defines two outer ends close to the first and second end sections of the rear tube respectively. Each of the first end sections of the front and rear tubes is provided with a first fastener to be connected to one of the first and second connection tubes, such that at least one of the two lateral supportive frames is adjustably connected to the front and rear tubes. The front tube defines a first fixing hole located between the first fastener and the immediate section of the front tube and a second fixing hole located at the intermediate section of the front tube. The seating unit can be moved along the front and rear tubes to have the positioning hole of the front guide shell aligned with one of the first and second fixing holes of the front tube. The first and second snap mechanisms are provided in the front tube corresponding to the first and second fixing holes respectively. Each of the first and second snap mechanisms includes an elastic member and a button capable of being urged by the elastic member to allow a front end of the button to enter one of the first and second fixing holes of the front tube. As such, when the positioning hole of the front guide shell is aligned with the first fixing hole of the front tube, the button of the first snap mechanism is urged by the associated elastic member to have the front end of the button enter the positioning hole of the front guide shell, so that the front guide shell is coupled to the front tube at the position of the first fixing hole, and the outer end of the at least one rear guide shell close to the first end section of the rear tube abuts against the first fastener located at the rear tube. When the positioning hole of the front guide shell is aligned with the second fixing hole of the front tube, the button of the second snap mechanism is urged by the associated elastic member to have the front end of the button enter the positioning hole of the front guide shell, so that the front guide shell is coupled to the front tube at the position of the second fixing hole.

In a preferred form, the at least one rear guide shell includes two spaced rear guide shells, and each rear guide shell defines one of the two outer ends of the at least one rear guide shell. A distance between the first and second fixing holes of the front tube is approximately equal to a distance between the outer end of the at least one rear guide shell close to the first end section of the rear tube and the first fastener located at the rear tube.

In a preferred form, each of the first and second connection tubes defines a plurality of adjustment holes, and each of the front and rear tubes defines two connection holes respectively in the first and second end sections thereof. The second end sections of the front and rear tubes are respectively provided with a second fastener to be connected to the first and second connection tubes. Each of the first and second fasteners is inserted through one of the adjustment holes of the associated first and second connection tubes and a corresponding connection hole of the front and rear tubes, so that the front and rear tubes are respectively connected to the first and second connection tubes of the two lateral supportive frames.

In a preferred form, the elastic member of each of the first and second snap mechanisms is substantially V-shaped and includes a first end connected with an associated button and a second end urged against an inner surface of the front tube.

In a preferred form, the front guide shell is provided with a cylindrical hollow body defining a bore communicating with the positioning hole of the front guide shell. The bathing auxiliary chair further includes an operation unit including an actuating stem inserted into the bore of the cylindrical hollow body. When the actuating stem is moved inwardly towards the positioning hole, the associated button is pushed by an inner end of the actuating stem to be clear of the positioning hole, so that the front guide shell can be decoupled from the front tube.

In a preferred form, the second end sections of the front and rear tubes are respectively provided with a second fastener to be connected to the first and second connection tubes. The front tube further defines a third fixing hole between the intermediate section and the second fastener, and the front tube is provided therein with a third snap mechanism including an elastic member and a button capable of being urged by the elastic member to enter the third fixing hole. The seating unit can be moved along the front and rear tubes to have the positioning hole of the front guide shell aligned with the third fixing hole of the front tube. When the positioning hole of the front guide shell is aligned with the third fixing hole of the front tube, the outer end of the at least one rear guide shell close to the second end section of the rear tube abuts against the second fastener located at the rear tube, and the button of the third snap mechanism is urged by the associated elastic member to further enter the positioning hole of the front guide shell, so that the front guide shell is coupled to the front tube at the position of the third fixing hole. A distance between the second and third fixing holes of the front tube is approximately equal to a distance between the outer end of the at least one rear guide shell close to the second end section of the rear tube and the second fastener located at the rear tube.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

A bathing auxiliary chair according to the preferred teachings of the present invention is shown in FIGS. 1 through 7 of the drawings and generally designated 10. The bathing auxiliary chair 10 can provide persons, who are disabled or impaired in mobility, to take a bath. The chair 10 can be adjusted in lateral width, so that it can be applied to bathtubs of different sizes. When a seat portion of the chair is moved to a location close to a sidewall of a bathtub 12, the chair can be fixed reliably, so that a user can leave or sit on the chair conveniently and safely.

Figure 7:
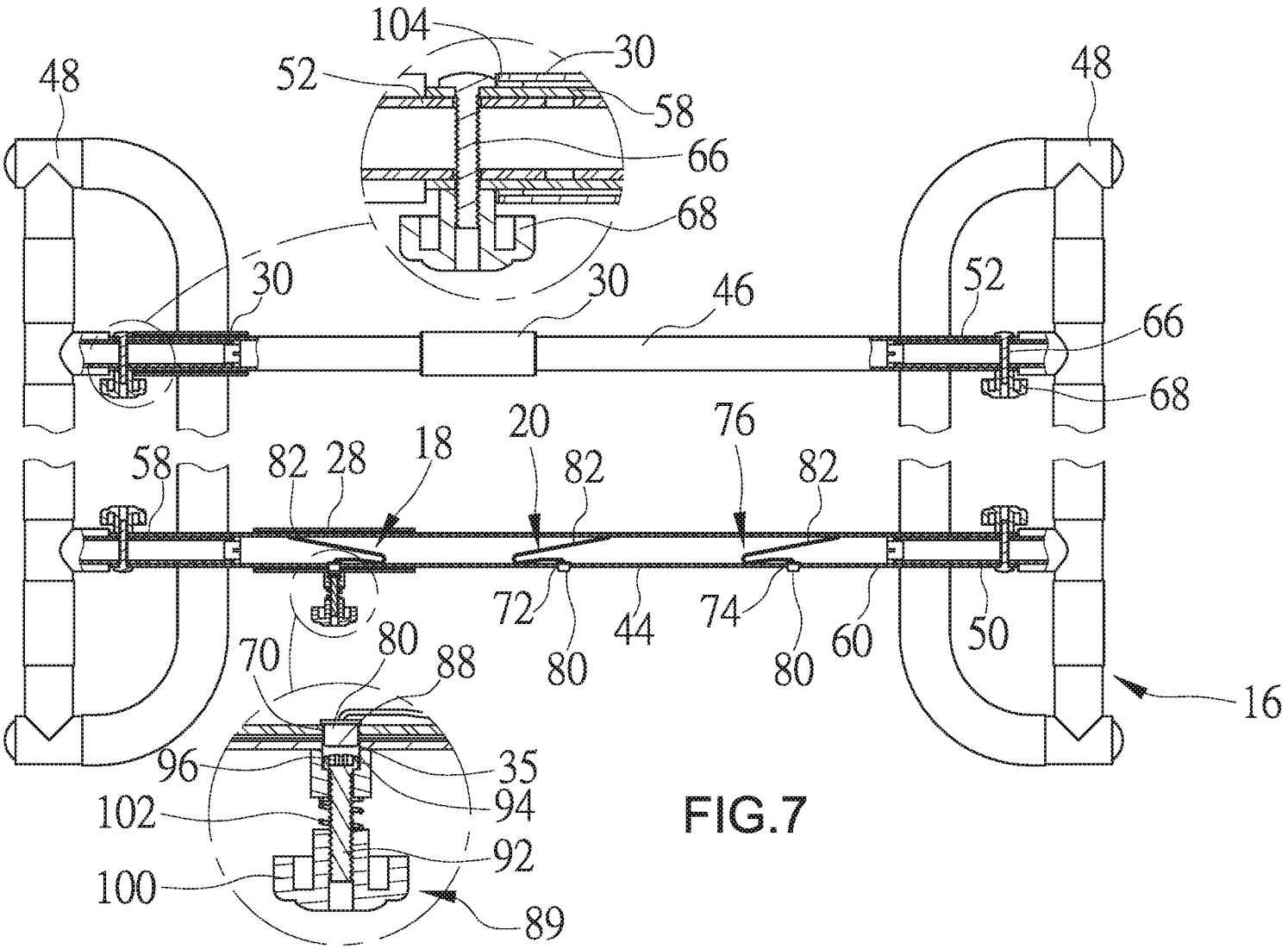
FIG. 7 shows a schematic view of the supporting unit and enlarged fragmentary views of parts circled in the schematic view, wherein a snap mechanism coupling a front guide shell to a front tube at a first position is demonstrated.
Figure 8:
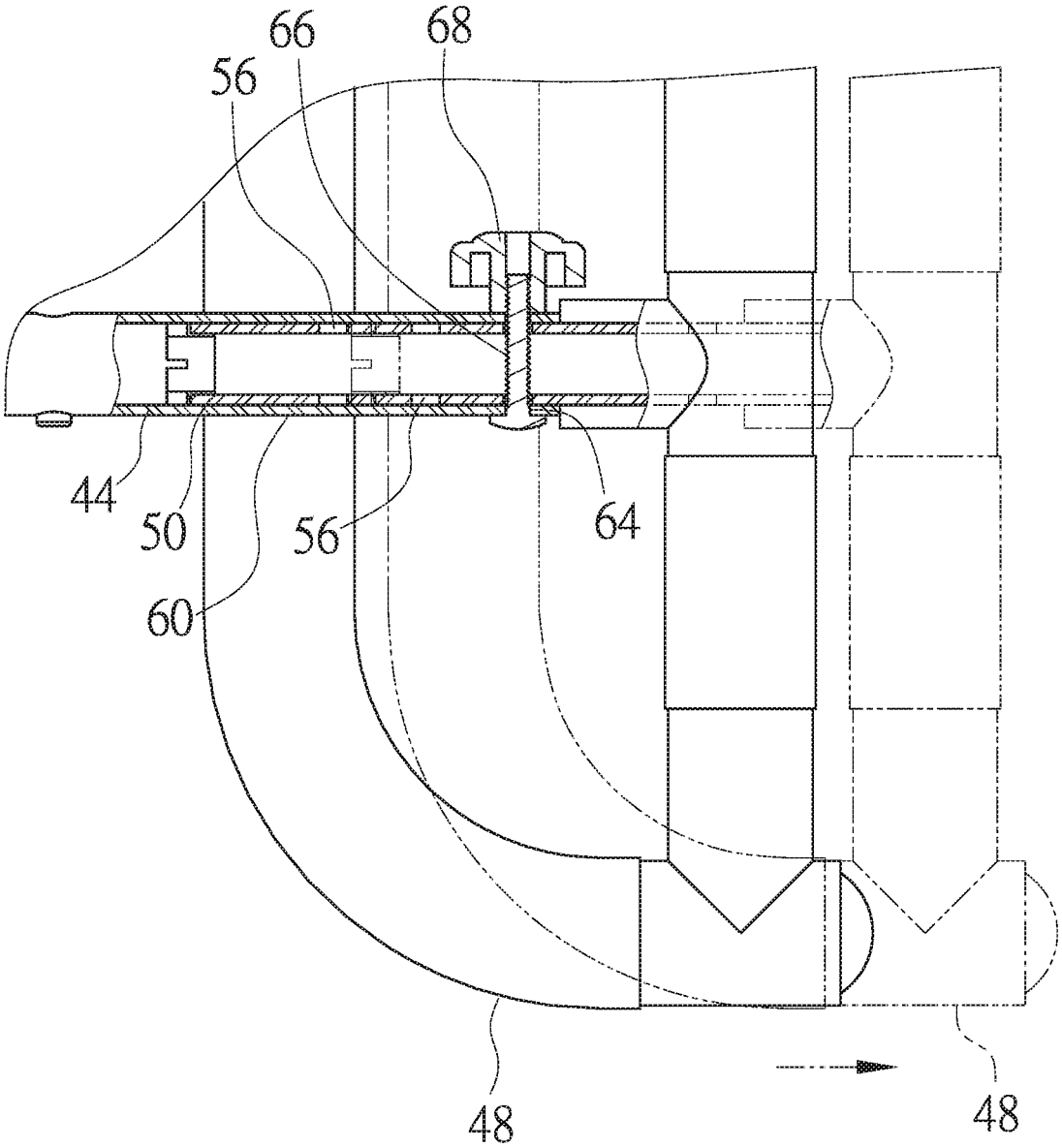
FIG. 8 shows an enlarged fragmentary view of the supporting unit of FIG. 7, wherein a lateral supportive frame capable of being adjusted relative to the front tube is demonstrated.

The bathing auxiliary chair 10 generally includes a seating unit 14, a supporting unit 16, and first and second snap mechanisms 18, 20 (see FIG. 7). The seating unit 14 includes a fixed plate 21, a seat portion 22, two arms 24 at two opposite lateral sides of the seat portion 22, and a back portion 26 at a rear side of the seat portion 22. The fixed plate 21 is provided with a front guide shell 28 at its front side, and at least one rear guide shell 30 at its rear side. In this embodiment, two spaced rear guide shells 30 are provided at the rear side of the fixed plate 21. In another embodiment, the two rear guide shells 30 can be joined together. The front guide shell 28 defines a central through-hole 32, in which a bush 34 can be provided, and a positioning hole 35 (see FIG. 7), which communicates with the central through-hole 32. The bush 34 defines a slot 36 which communicates with the positioning hole 35. The seat portion 22 is mounted above the fixed plate 21. In this embodiment, a movable plate 38 is provided between the seat portion 22 and a fixed plate 21, and the seat portion 22 is joined to the movable plate 38 (see FIG. 2). More specifically, the movable plate 38 can be fixed to the fixed plate 21 by a positioning pin 41, and the movable plate 38 can be rotated about the fixed plate 21 by an operation bar 40 to adjust the orientation of the seat portion 22. Since the present invention does not focus on the orientation adjustment mechanism for the seat portion 22, more detailed description therefor is omitted.

The supporting unit 16 includes two lateral supportive frames 42, a front tube 44, and a rear tube 46, wherein both tubes 44, 46 are connected between the two lateral supportive frames 42. Each lateral supportive frame 42 includes a base rod 48 extending in a longitudinal direction, and first and second connection tubes 50, 52 extending inwardly from the base rod 48 towards the seating unit 14 in a transverse direction perpendicular to the longitudinal direction. The first and second connection tubes 50, 52 are spaced in the longitudinal direction and each define a plurality of adjustment holes 56. The base rods 48 of the two lateral supportive frames 42 can be placed on two opposite sidewalls 54 of the bathtub 12 (see FIG. 3). Each of the front and rear tubes 44, 46 has a first end section 58, a second end section 60, and an intermediate section 62 between the first and second end sections 58, 60. The front tube 44 extends in the transverse direction through the front guide shell 28 to have the first and second end sections 58, 60 thereof connected with the first connection tubes 50 of the two lateral supportive frames 42. The rear tube 46, which is parallel to the front tube 44, extends in the transverse direction through the rear guide shells 30 to have the first and second section end sections 58, 60 thereof connected with the second connection tubes 52 of the two lateral supportive frames 42. As such, the seating unit 14 can be movably installed on the front tube 44 and the rear tube 46. Further, the front guide shell 28 and the rear guide shells 30 each can be provided therein with the bush 34 to facilitate the front and rear guide shells 28, 30 moving along the front and rear tubes 44, 46. Furthermore, the front and rear tubes 44, 46 can be adjustably connected to at least one of the two lateral supportive frames 42, so that the distance between the base rods 48 can be adjusted (see FIG. 6). Thus, the bathing auxiliary chair 10 can be placed on the sidewalls 54 of bathtubs 12 of different sizes.

In this embodiment, each of the front and rear tubes 44, 46 defines two connection holes 64 respectively at its first and second end sections 58, 60, and a fastener 66 extends through each of the connection holes 64. More specifically, one of the fasteners 66 can be inserted through a corresponding connection hole 64 of the front tube 44 and one of the adjustment holes 56 of the first connection tube 50, so that the front tube 44 can be adjustably connected between the two lateral supportive frames 42 (see FIG. 7). Similarly, one of the fasteners 66 can be inserted through a corresponding connection hole 64 of the rear tube 46 and one of the adjustment holes 56 of the second connection tube 52, so that the rear tube 46 can be adjustably connected between the two lateral supportive frames 42 (see FIG. 7). More specifically, each fastener 66 can be made in the form of a bolt, and a nut 68 can be releasably connected with the bolt to connect the front and rear tubes 44, 66. In use, one of the lateral supportive frames 42 can be detached from the front and rear tubes 44, 46 by taking apart two corresponding fasteners 66. Next, each of the two fasteners 66 can be inserted through another adjustment hole 56 to connect the lateral supportive frame 42 with the front and rear tubes 44, 46, thus adjusting the distance between the two lateral supportive frames 42.

Figure 1:
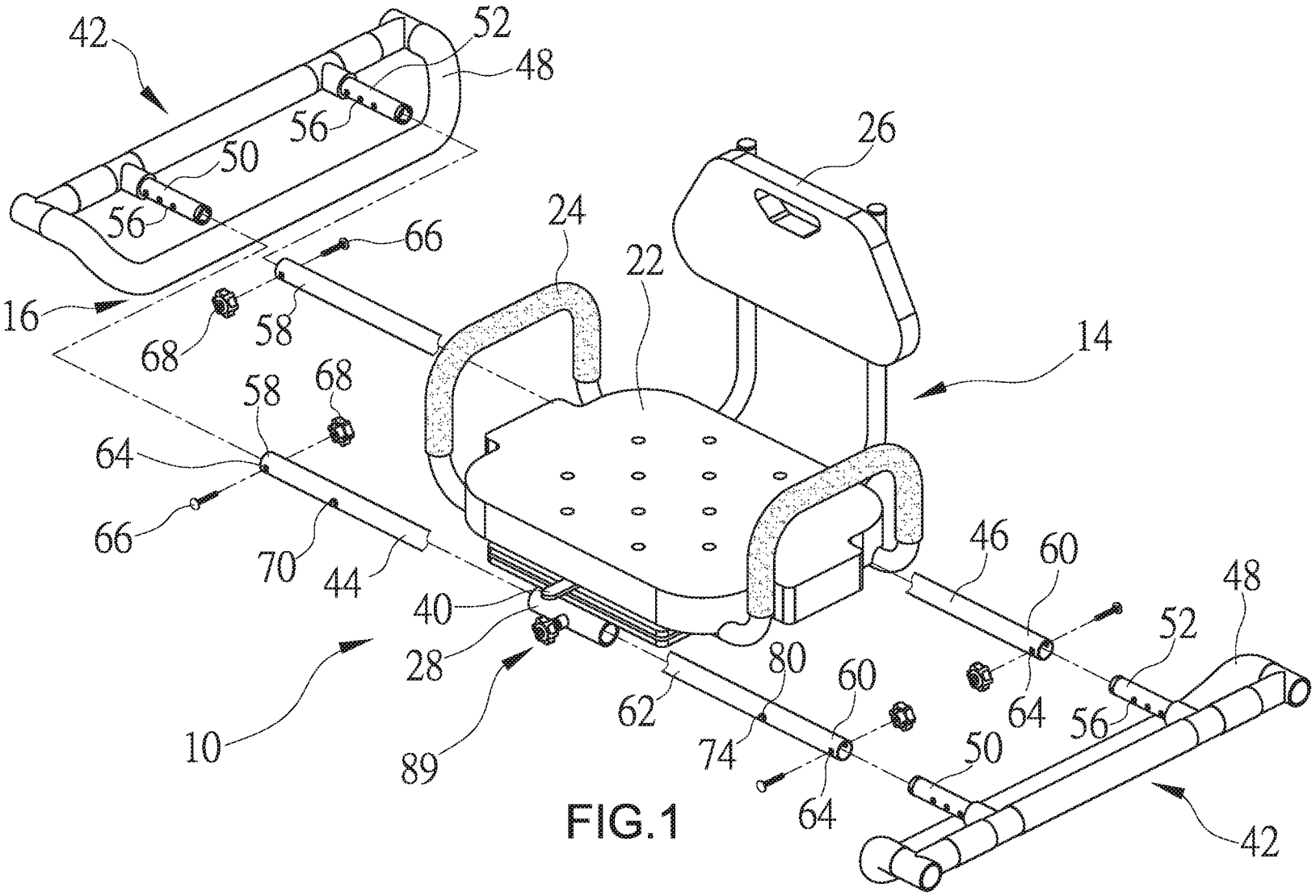
FIG. 1 shows an exploded view of a bathing auxiliary chair in accordance with an embodiment of the present invention.
Figure 2:
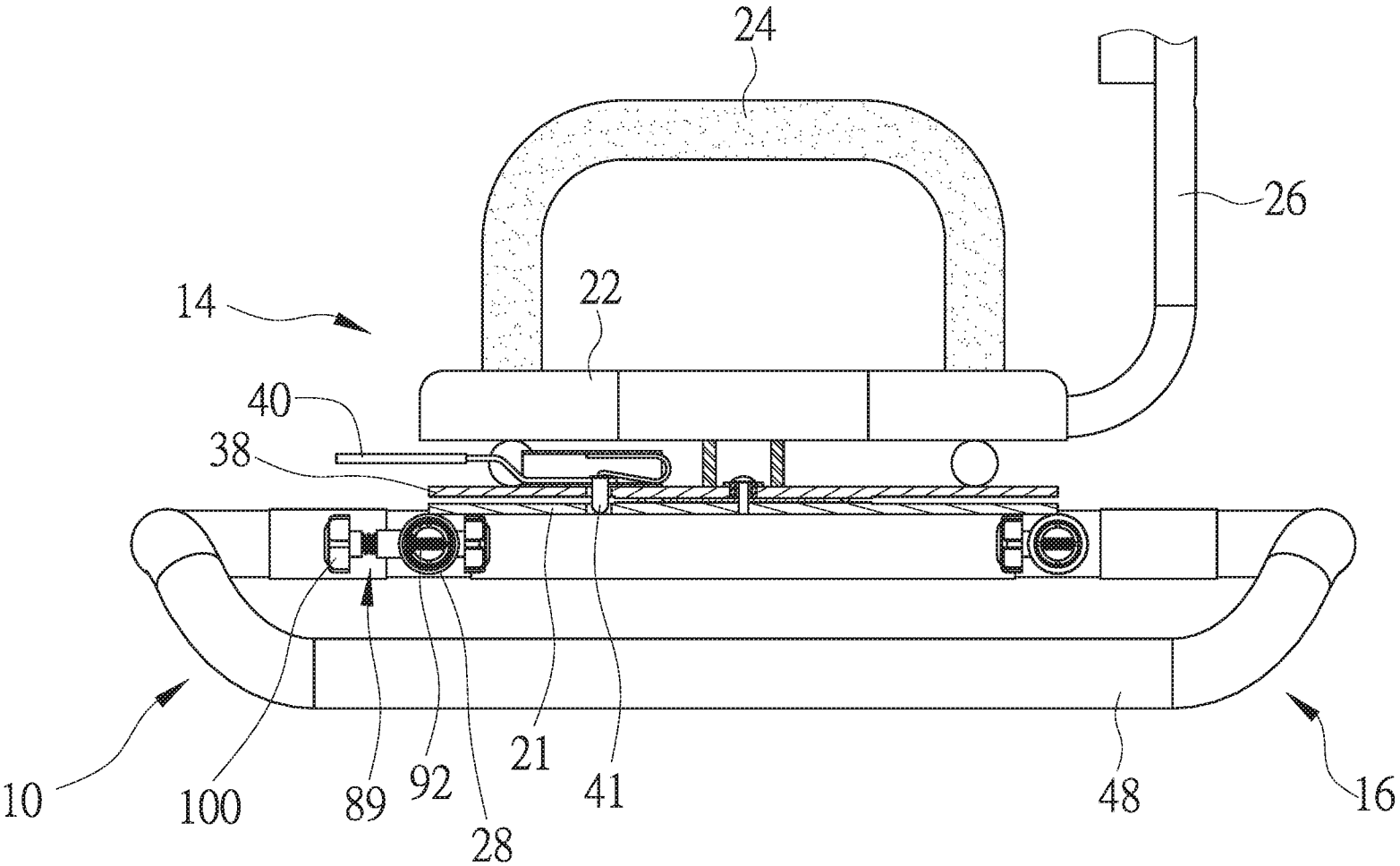
FIG. 2 shows a sectional view of the bathing auxiliary chair of FIG. 1.
Figure 3:
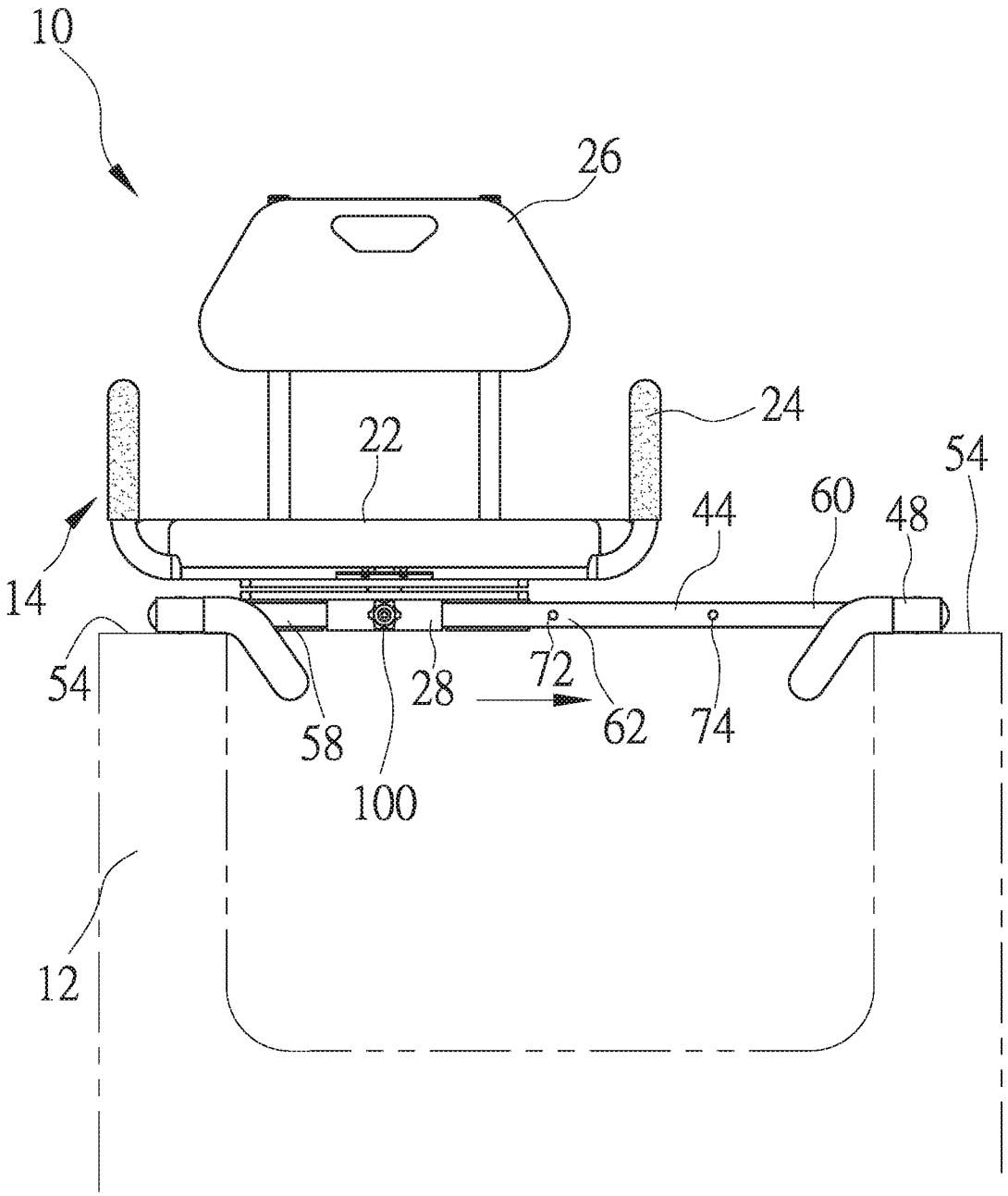
FIG. 3 shows a schematic view of the bathing auxiliary chair of FIG. 1 placed on a bathtub, with a seating unit thereof located close to a sidewall of the bathtub.
Figure 4:
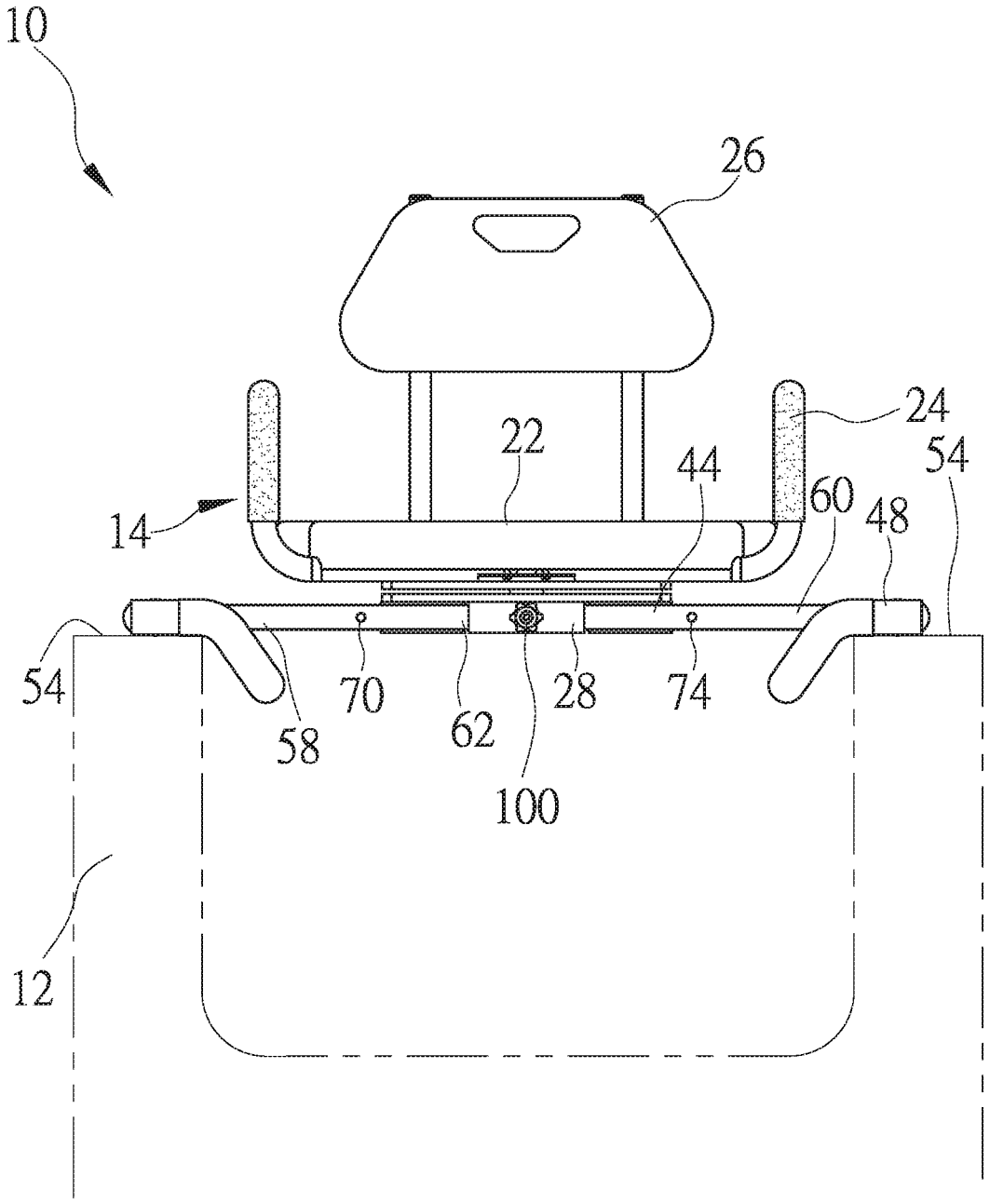
FIG. 4 shows a schematic view of the bathing auxiliary chair of FIG. 1 placed on a bathtub, with the seating unit thereof located at a central area of the bathtub.
Figure 5:
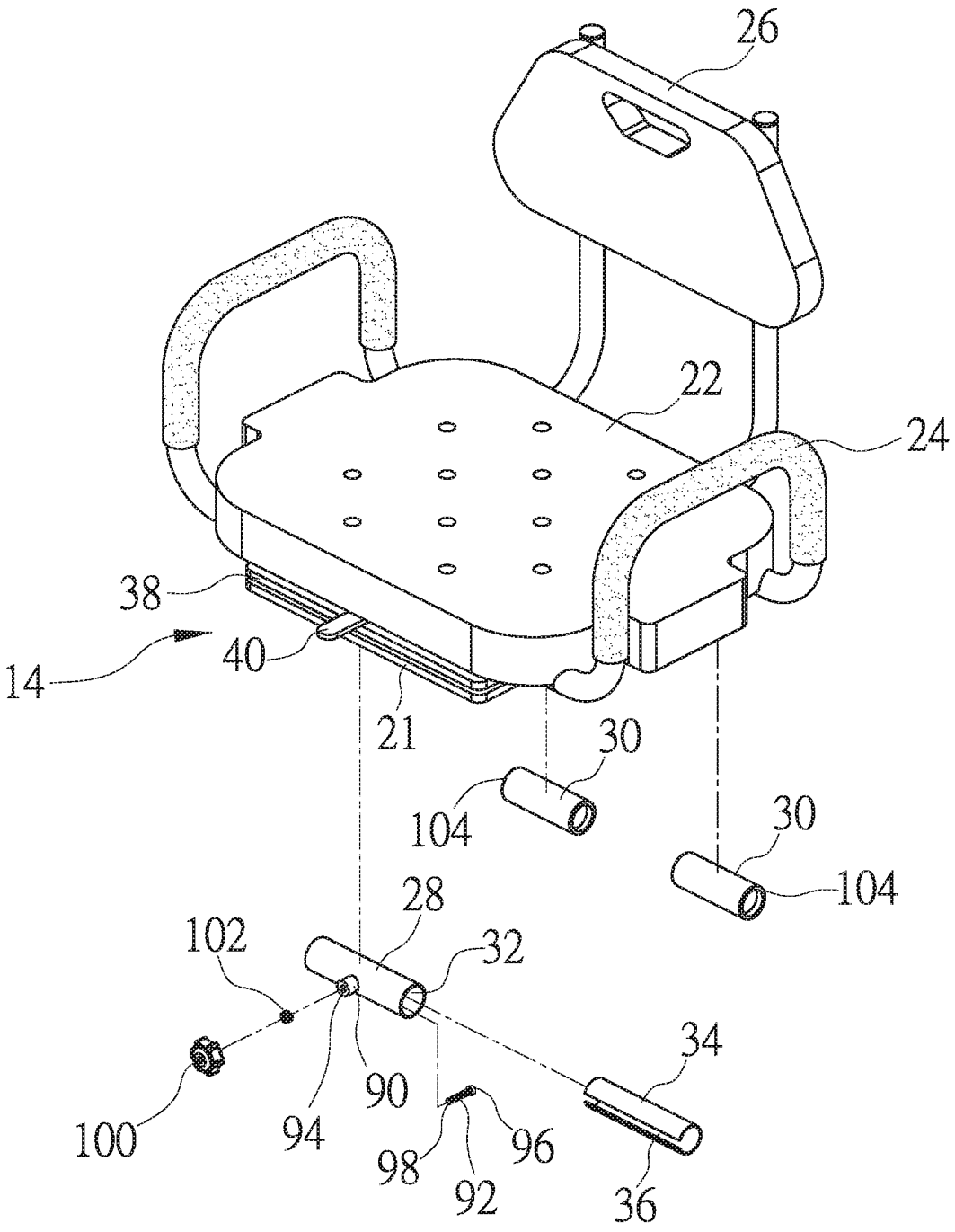
FIG. 5 shows an exploded view of the seating unit of the bathing auxiliary chair of FIG. 1.
Figure 6:
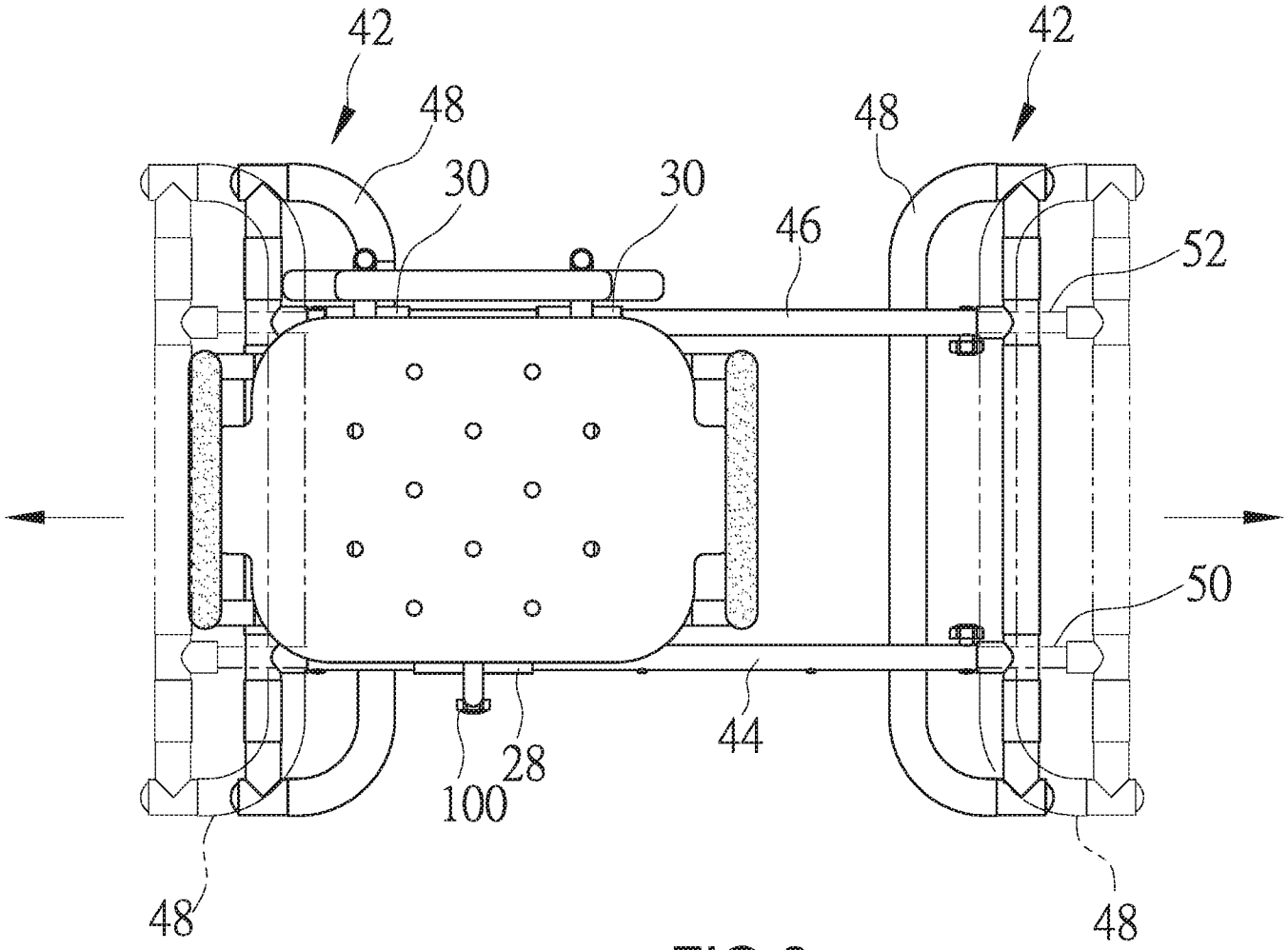
FIG. 6 shows a top view of the bathing auxiliary chair of FIG. 3, wherein a supporting unit thereof capable of being adjusted in width is demonstrated.
Figure 11:
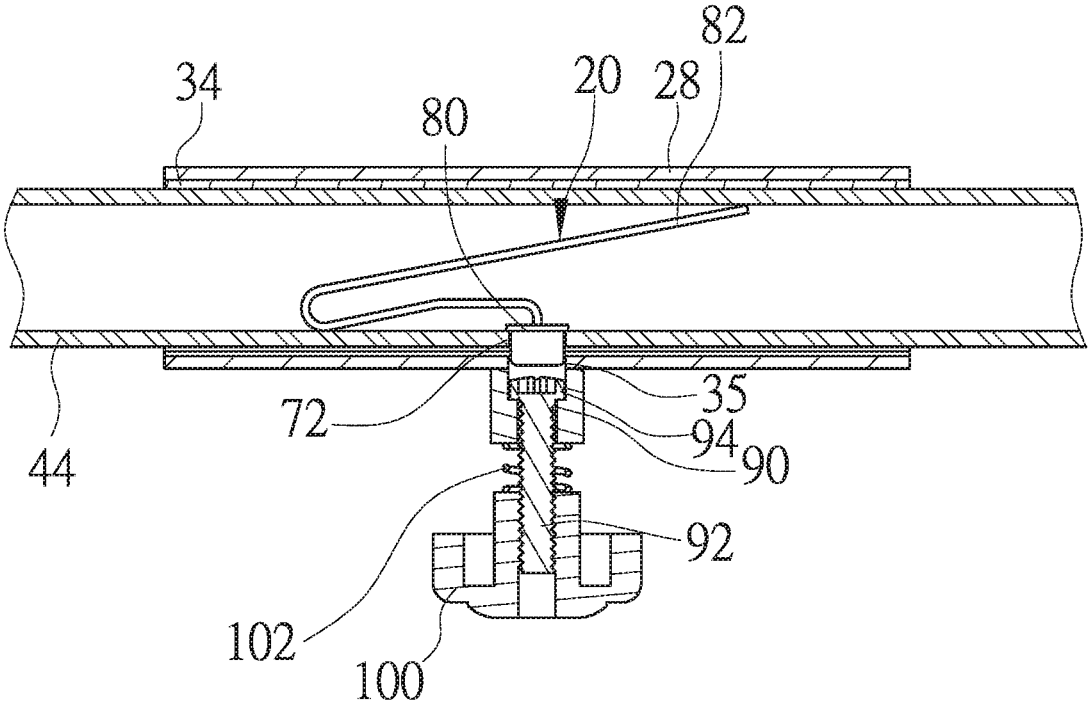
FIG. 11 shows an enlarged fragmentary view similar to FIG. 9, wherein the front guide shell located at the second position is demonstrated.

As shown in FIGS. 1, 3 and 4, the front tube 44 defines a first fixing hole 70, a second fixing hole 72, and a third fixing hole 74. The first fixing hole 70 is located between the intermediate section 62 and the connection hole 64 (the fastener 66) defined at the first end section 58, the second fixing hole 72 is located at the intermediate section 62, and the third fixing hole 74 is located between the intermediate section 62 and the connection hole 64 (the fastener 66) defined at the second end section 60. When the seating unit 14 together with the front and rear guide shells 28, 30 are moved along the front and rear tubes 44, 46, the positioning hole 35 of the front guide shell 28 can be aligned with the first fixing hole 70, the second fixing hole 72, or the third fixing hole 74 (see FIGS. 7, 11 and 12).

The first and second snap mechanisms 18, 20 are provided in the front tube 44 corresponding to the first and second fixing holes 70, 72 respectively (see FIG. 7). Each snap mechanism includes a button 80 and a substantially V-shaped elastic member 82 which has a first end 84 connected with the button 80 and a second end 86 urged against an inner surface of the front tube 44 (see FIG. 9). Thus, the buttons 80 can be forced outwardly by the elastic members 82 to enter the first and second fixing holes 70, 72. More specifically, each button 80 has a front end 88, which is configured as a curved or bevel surface and can extend out of a corresponding fixing hole of the front tube 44. The front guide shell 28 can be moved together with the seating unit 14. When the positioning hole 35 is aligned with the first fixing hole 70 or the second fixing hole 72, the front end 88 of a button 80 may enter the first fixing hole 70 or the second fixing hole 72, so that the front guide shell 28 can be coupled to the front tube 44. On the other hand, when the button 80 is pushed inwardly, the front end 88 of the button 80 can be clear of the positioning hole 35, so that the front guide shell 28 can be decoupled from the front tube 44.

Figure 9:
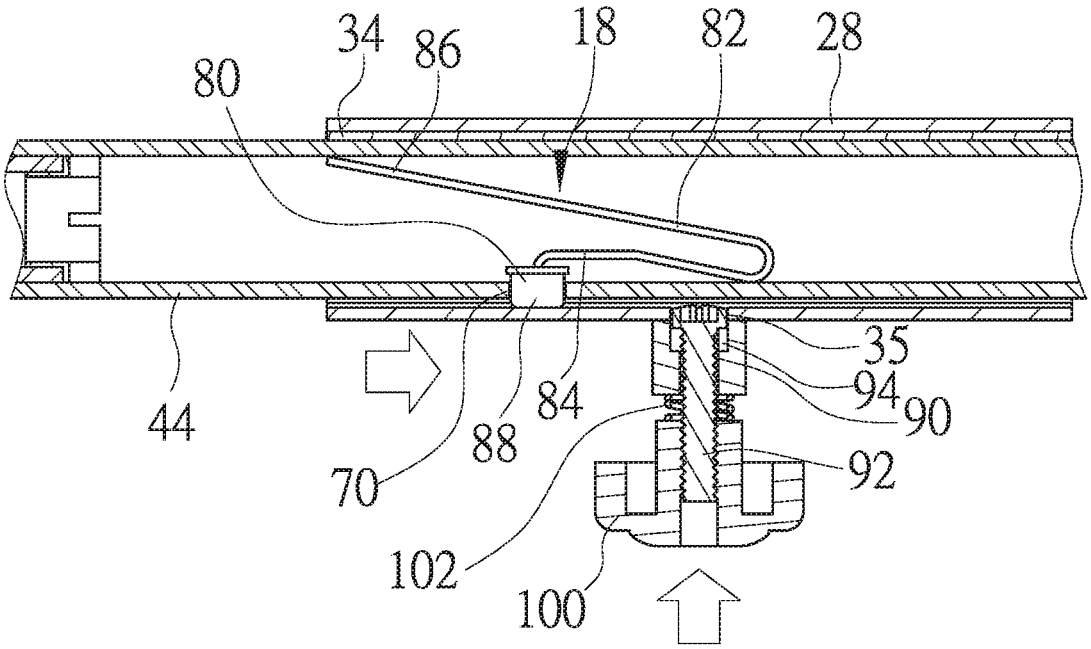
FIG. 9 shows an enlarged fragmentary view in FIG. 7, wherein the front guide shell decoupled from the front tube and capable of moving along the front tube is demonstrated.

The front guide shell 28 can be provided with a cylindrical hollow body 90 defining a bore 94 communicating with the positioning hole 35 of the front guide shell 28 (see FIG. 9). The bathing auxiliary chair 10 may further include an operation unit 89 including an actuating stem 92 inserted into the bore 94 of the cylindrical hollow body 90 (see FIG. 7). The actuating stem 92 has an inner end 96 and an outer end 98. The inner end 96 is inserted into the bore 94, and the outer end 98 is connected with a press head 100. When the actuating stem 92 is moved inwardly towards the positioning hole 35, the button 80 entering the positioning hole 35 can be pushed by the inner end 96 of the actuating stem 92 to move back, thus being clear of the positioning hole 35. In this embodiment, the operation unit 89 may further include a coil spring 102 located between the cylindrical hollow body 90 and the press head 100. In an implementable embodiment, the spring 102 can be omitted.

Figure 10:
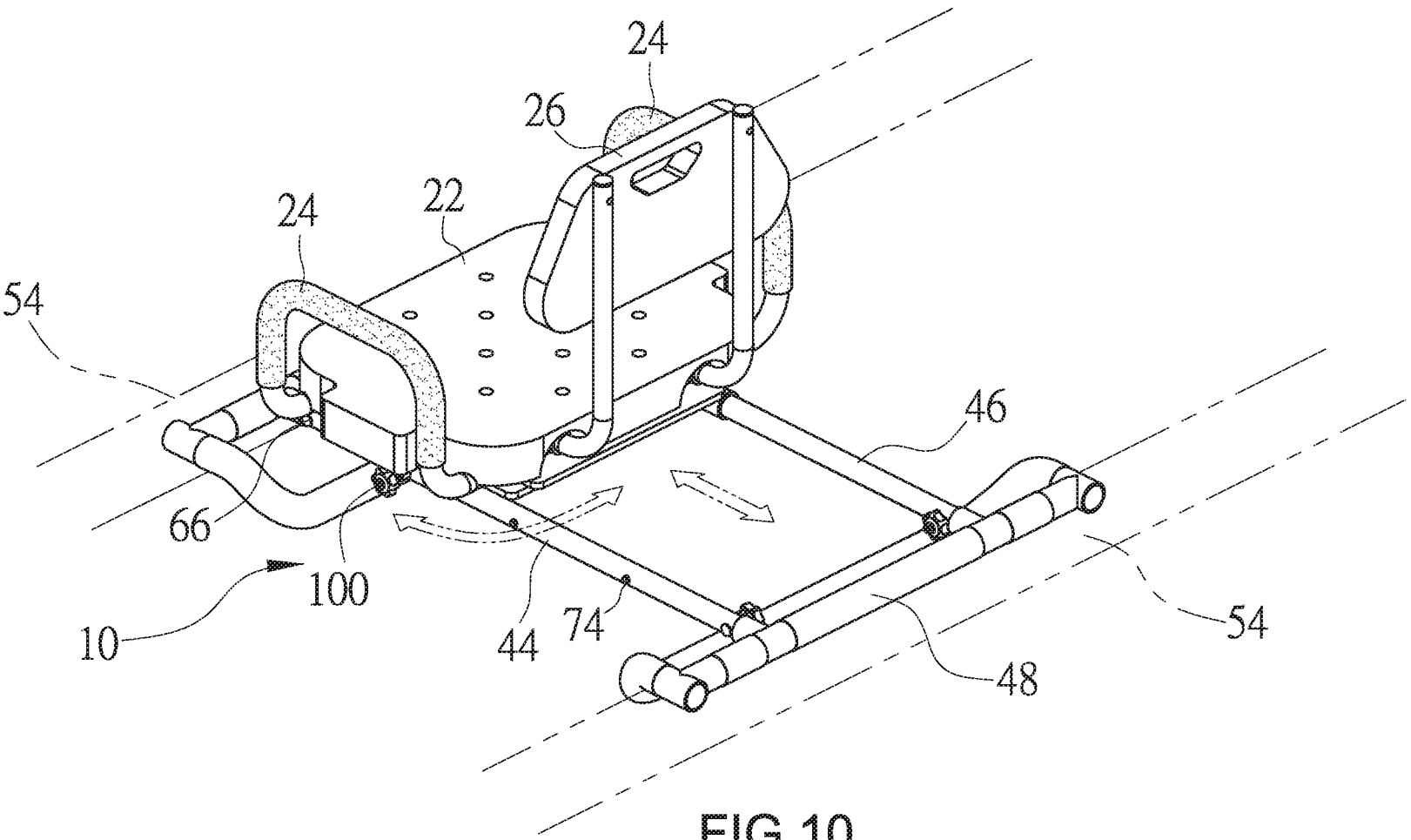
FIG. 10 shows a schematic view of the bathing auxiliary chair in FIG. 3, wherein the seating unit capable of rotating about 90 degrees is demonstrated.

Referring to FIGS. 3 and 4, the seating unit 14 of the bathing auxiliary chair 10 can be operated to move between a first position and a second position. When the seat portion 22 together with the front guide shell 28 is moved to the first position (close to the first end section 58, see FIG. 3), the front end 88 of the button 80 at the first fixing hole 70 may enter the positioning hole 35 of the front guide shell 28, thus fixing the seating unit 14 at the first position (see FIG. 7). When the seating unit 14 is at the first position, the seat portion 22 is close to a sidewall 54 of the bathtub 12. Furthermore, at the first position, the seating unit 14 can be adjusted in orientation (see FIG. 10) to allow a user to leave or sit on the seat portion 22 easily. When the seating unit 14 is moved to the second position (at the intermediate section 62, see FIG. 4), the front end 88 of the button 80 at the second fixing hole 72 may enter the positioning hole 35 of the front guide shell 28 (see FIG. 11), thus fixing the seating unit 14 at the second position. When the seating unit 14 is located at the second position, the seat portion 22 is close to the central area of the bathtub 12 (see FIG. 4), where a user can proceed with a bath easily.

For moving the seating unit 14 from the first position to the second position, a user may depress the press head 100 to have the inner end 96 of the actuating stem 92 push the button 80, so that the front end 88 of the button 80 can be clear of the positioning hole 35 without requiring the button 80 to be removed from the first fixing hole 70. Thereafter, the user may push the front guide shell 28 together with seating unit 14 to move towards the second position (see FIG. 9). When the positioning hole 35 is aligned with the second fixing hole 72, the button 80 of the second snap mechanism 20 can be urged by the associated elastic member 82 to have the front end 88 of the button enter the positioning hole 35 of the front guide shell 28, so that the seating unit 14 can be fixed at the second position (see FIG. 11). On the other hand, for moving the seating unit 14 from the second position to the first position, the user may depress the press head 100 to push the button 80 to move inwardly, so that the front end 88 of the button 80 can be clear of the positioning hole 35. Next, the seating unit 14 can be pushed to move from the second position to the first position, and then the seating unit 14 can be fixed at the first position.

Figure 12:
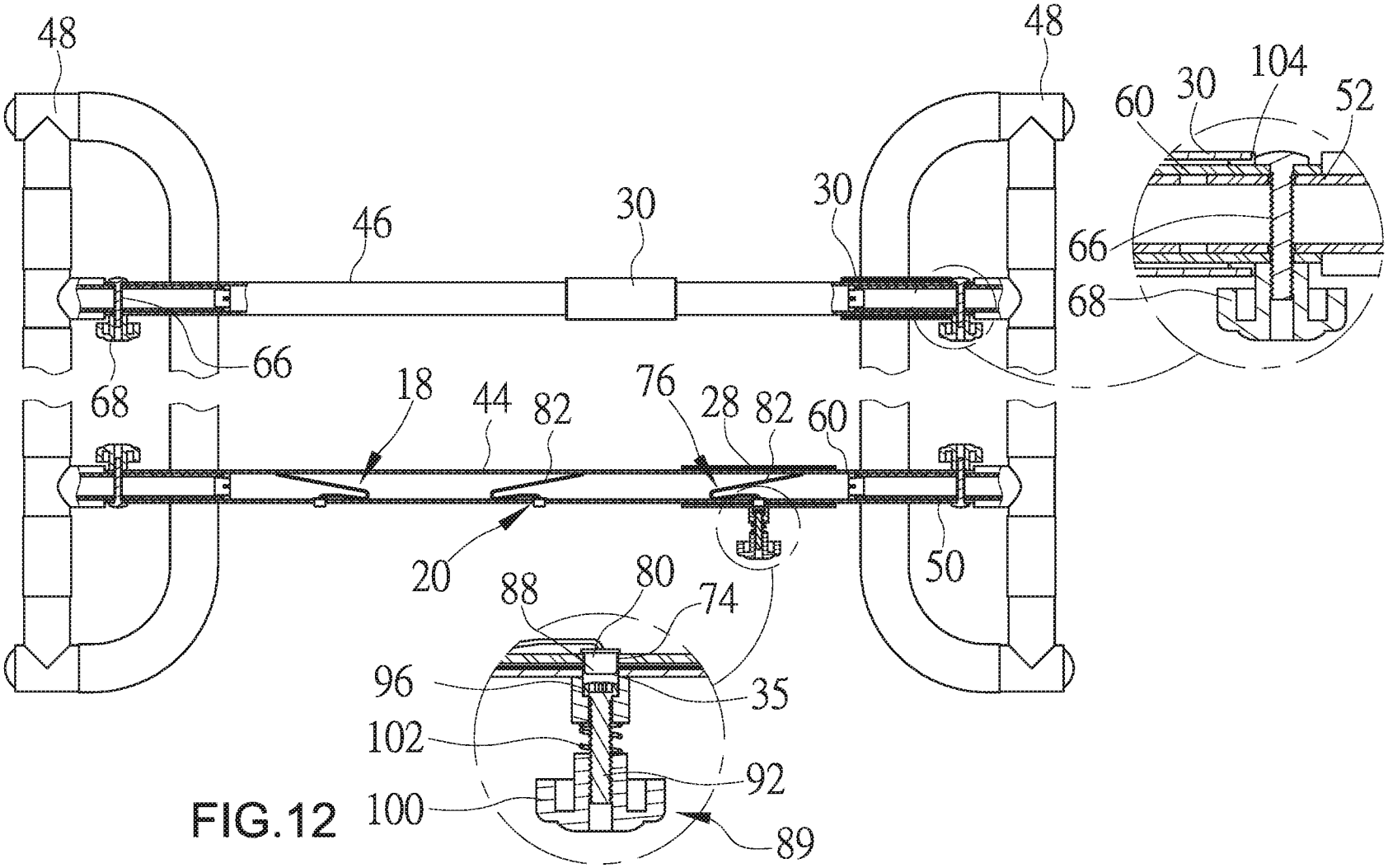
FIG. 12 shows a schematic view similar to FIG. 7 and enlarged fragmentary views of parts circled in the schematic view, wherein a snap mechanism coupling the front guide shell to a front tube at a third position is demonstrated.

The bathing auxiliary chair 10 may further include a third snap mechanism 76 located in the front tube 44 corresponding to the third fixing hole 74 (see FIG. 12). The third snap mechanism 76 includes a button 80 and an elastic member 82. When the seating unit 14 is moved to a third position (close to second end section 60, see FIG. 12), the positioning hole 35 of the front guide shell 28 can be aligned with the third fixing hole 74, and thus the button 80 of the third snap mechanism 76 can be urged by the associated elastic member 82 to have its front end 88 enter the positioning hole 35, thus coupling the front guide shell 28 to the front tube 44. When depressing the press head 100, the button 80 of the third snap mechanism 76 can be pushed inwardly to be clear of the positioning hole 35, thus decoupling the front guide shell 28 from the front tube 44. When the seating unit 14 is located at the third position, the seat portion 22 is close to an opposite side wall 54 of the bathtub 12, where the seating unit 14 can also be adjusted in orientation to allow a user to leave or sit on the seat portion 22 easily. In use, after the bathing auxiliary chair 10 is placed on two sidewalls of a bathtub, the seating unit 14 may be located at the first or third position to facilitate a user leaving or sitting on the seat portion 22.

Referring again to FIG. 7, when the seating unit 14 is located at the first position, in addition to the front guide shell 28 being coupled to the front tube 44 by the first snap mechanism 18, an outer end 104 of the rear guide shell 30 close to the first end section 58 of the rear tube 46 abuts against the fastener 66 at the first end section 58 of the rear tube 46. When the seating unit 14 is located at the third position, as shown in FIG. 12, in addition to the front guide shell 28 being coupled to the front tube 44 by the third snap mechanism 76, an outer end 104 of the rear guide shell 30 close to the second end section 60 of the rear tube 46 abuts against the fastener 66 at the second end section 60 of the rear tube 46. As such, the seating unit 14 can be fixed at first or third position reliably to allow a user leaving or sitting on the chair easily and safely. In addition, the outer ends 104 of the rear guide shells 30 abut against the associated fasteners 66 to produce, for example, a slight impact sound or feel when the seating unit 14 has reached the first or third position, and this informs the user of the seating unit 14 having been moved to the position suitable for leaving or sitting on the seat portion 22.

Figure 13:
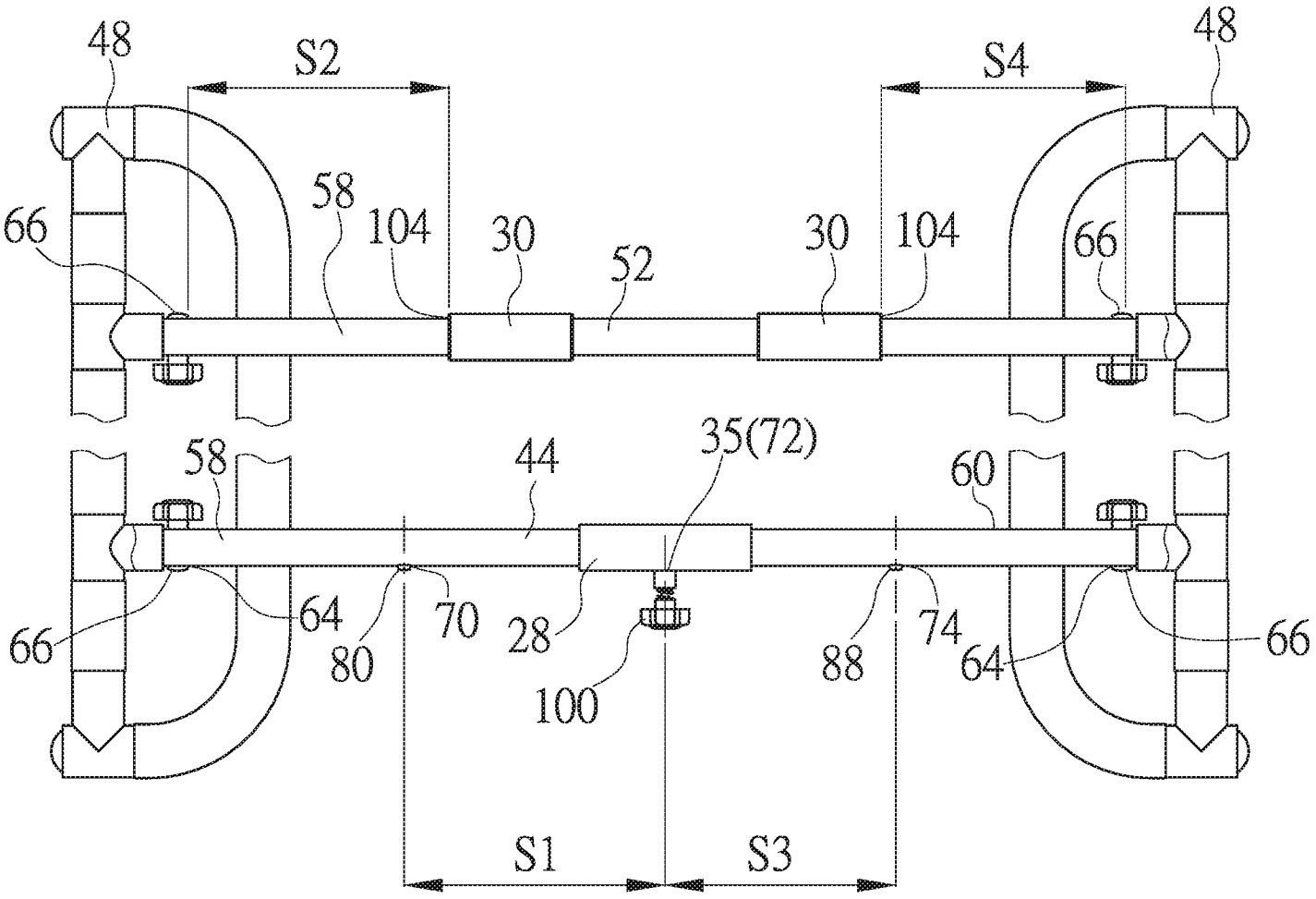
FIG. 13 shows a schematic view similar to FIG. 7, wherein the arrangement of the front guide shell and the rear guide shells are demonstrated.

More specifically, as shown in FIG. 13, the distance (S1) between the first and second fixing holes 70, 72 of the front tube 44 is approximately equal to the distance (S2) between the outer end 104 of the rear guide shell 30 close to the first end section 58 of the rear tube 46 and the fastener 66 located at the first end section 58 of the rear tube 46. The distance (S3) between the second and third fixing holes 72, 74 of the front tube 44 is approximately equal to the distance (S4) between the outer end 104 of the rear guide shell 30 close to the second end section 60 of the rear tube 46 and the fastener 66 located at the second end section 60 of the rear tube 46. As such, when the seating unit 14 is moved to the first position (close to the first end section 58 of the front tube 44) or the third position (close to the second end section 60 of the front tube 44), the outer end 104 of one of the rear guide shells 30 may abut against a corresponding fastener 66.

The scope of the invention is to be indicated by the appended claims, rather than by the foregoing description, and all changes which come within the meaning and range of equivalency of the claims are intended to be embraced therein.

The invention claimed is:

1. A bathing auxiliary chair comprising:

a seating unit including a fixed plate, a seat portion mounted above the fixed plate, a front guide shell provided at a front side of the fixed plate, and at least one rear guide shell provided at a rear side of the fixed plate, with the front guide shell defining a central through-hole and a positioning hole communicating with the through-hole;

a supporting unit including a front tube, a rear tube, and two lateral supportive frames spaced in a transverse direction and adapted to be placed on two opposite sidewalls of a bathtub respectively, with each lateral supportive frame including a base rod and first and second connection tubes spaced in longitudinal direction perpendicular to the transverse direction and extending inwardly from the base rod in the transverse direction, with the front and rear tubes each having a first end section, a second end section, and an intermediate section between the first and second end sections, with the front tube extending in the transverse direction through the front guide shell, with the first and second end sections of the front tube connected with the first connection tubes of the two lateral supportive frames, with the rear tube extending in the transverse direction through the at least one rear guide shell, with the first and second end sections of the rear tube connected with the second connection tubes of the two lateral supportive frames, wherein the at least one rear guide shell defines two outer ends close to the first and second end sections of the rear tube respectively, wherein each of the first end sections of the front and rear tubes is provided with a first fastener to be connected to one of the first and second connection tubes, such that at least one of the two lateral supportive frames is adjustably connected to the front and rear tubes, wherein the front tube defines a first fixing hole located between the first fastener and the immediate section of the front tube and a second fixing hole located at the intermediate section of the front tube, wherein the seating unit can be moved along the front and rear tubes to have the positioning hole of the front guide shell aligned with one of the first and second fixing holes of the front tube; and first and second snap mechanisms provided in the front tube corresponding to the first and second fixing holes respectively, with the first and second snap mechanisms each including an elastic member and a button capable of being urged by the elastic member to allow a front end of the button to enter one of the first and second fixing holes of the front tube, wherein when the positioning hole of the front guide shell is aligned with the first fixing hole of the front tube, the button of the first snap mechanism is urged by the associated elastic member to have the front end of the button enter the positioning hole of the front guide shell, so that the front guide shell is coupled to the front tube at the position of the first fixing hole, and the outer end of the at least one rear guide shell close to the first end section of the rear tube abuts against the first fastener located at the rear tube; wherein when the positioning hole of the front guide shell is aligned with the second fixing hole of the front tube, the button of the second snap mechanism is urged by the associated elastic member to have the front end of the button enter the positioning hole of the front guide shell, so that the front guide shell is coupled to the front tube at the position of the second fixing hole.

2. The bathing auxiliary chair of claim 1, wherein the at least one rear guide shell includes two spaced rear guide shells, with each of the two rear guide shell defining one of the two outer ends of the at least one rear guide shell, wherein a distance between the first and second fixing holes of the front tube is approximately equal to a distance between the outer end of the at least one rear guide shell close to the first end section of the rear tube and the first fastener located at the rear tube.

3. The bathing auxiliary chair of claim 2, wherein the first and second connection tubes each defines a plurality of adjustment holes, with each of the front and rear tubes defining two connection holes respectively in the first and second end sections thereof, with the second end sections of the front and rear tubes respectively provided with a second fastener to be connected to the first and second connection tubes, with each of the first and second fasteners inserted through one of the adjustment holes of the associated first and second connection tubes and a corresponding connection hole of the front and rear tubes, so that the front and rear tubes are respectively connected to the first and second connection tubes of the two lateral supportive frames.

4. The bathing auxiliary chair of claim 2, wherein the elastic member of each of the first and second snap mechanisms is substantially V-shaped and includes a first end connected with an associated button and a second end urged against an inner surface of the front tube.

5. The bathing auxiliary chair of claim 2, wherein the front guide shell is provided with a cylindrical hollow body defining a bore communicating with the positioning hole of the front guide shell, wherein the bathing auxiliary chair further includes an operation unit including an actuating stem inserted into the bore of the cylindrical hollow body, wherein when the actuating stem is moved inwardly towards the positioning hole, the associated button is pushed by an inner end of the actuating stem to be clear of the positioning hole, so that the front guide shell can be decoupled from the front tube.

6. The bathing auxiliary chair of claim 1, wherein the first and second connection tubes each defines a plurality of adjustment holes, with each of the front and rear tubes defining two connection holes respectively in the first and second end sections thereof, with the second end sections of the front and rear tubes respectively provided with a second fastener to be connected to the first and second connection tubes, with each of the first and second fasteners inserted through one of the adjustment holes of the associated first and second connection tubes and a corresponding connection hole of the front and rear tubes, so that the front and rear tubes are respectively connected to the first and second connection tubes of the two lateral supportive frames.

7. The bathing auxiliary chair of claim 1, wherein the elastic member of each of the first and second snap mechanisms is substantially V-shaped and includes a first end connected with an associated button and a second end urged against an inner surface of the front tube.

8. The bathing auxiliary chair of claim 1, wherein the front guide shell is provided with a cylindrical hollow body defining a bore communicating with the positioning hole of the front guide shell, wherein the bathing auxiliary chair further includes an operation unit including an actuating stem inserted into the bore of the cylindrical hollow body, wherein when the actuating stem is moved inwardly towards the positioning hole, the associated button is pushed by an inner end of the actuating stem to be clear of the positioning hole, so that the front guide shell can be decoupled from the front tube.

9. The bathing auxiliary chair of claim 1, wherein the second end sections of the front and rear tubes are respectively provided with a second fastener to be connected to the first and second connection tubes, with the front tube further defining a third fixing hole between the intermediate section and the second fastener, with the front tube provided therein with a third snap mechanism including an elastic member and a button capable of being urged by the elastic member to enter the third fixing hole, wherein the seating unit can be moved along the front and rear tubes to have the positioning hole of the front guide shell aligned with the third fixing hole of the front tube, wherein when the positioning hole of the front guide shell is aligned with the third fixing hole of the front tube, the outer end of the at least one rear guide shell close to the second end section of the rear tube abuts against the second fastener located at the rear tube, and the button of the third snap mechanism is urged by the associated elastic member to further enter the positioning hole of the front guide shell, so that the front guide shell is coupled to the front tube at the position of the third fixing hole.

10. The bathing auxiliary chair of claim 9, wherein the at least one rear guide shell includes two spaced rear guide shells, with each rear guide shell defining one of the two outer ends of the at least one rear guide shell, wherein a distance between the second and third fixing holes of the front tube is approximately equal to a distance between the outer end of the at least one rear guide shell close to the second end section of the rear tube and the second fastener located at the rear tube.

* * * * *